United States Patent [19]

Tanikawa

[11] 4,027,902

[45] June 7, 1977

[54] JOINT FOR CULVERT SECTIONS AND THE LIKE

[75] Inventor: Takayoshi Tanikawa, Zentsuji, Japan

[73] Assignee: Seibu Polymer Kasei Kabushiki Kaisha, Tokyo, Japan

[22] Filed: Mar. 23, 1976

[21] Appl. No.: 669,527

[30] Foreign Application Priority Data

Mar. 27, 1975 Japan ..... 50-37338

[52] U.S. Cl. ..... 285/114; 285/226; 285/230

[51] Int. Cl.[2] ..... F16L 27/02

[58] Field of Search ..... 285/114, 226, 227, 228, 285/229, 288, 230; 61/43

[56] References Cited

UNITED STATES PATENTS

| | | | |
|---|---|---|---|
| 2,616,255 | 11/1952 | Altorfer | 285/228 X |
| 3,527,481 | 9/1970 | Lewis | 285/114 |
| 3,606,392 | 9/1971 | Garrett | 285/114 X |
| 3,725,565 | 4/1973 | Schmidt | 285/226 X |
| 3,729,939 | 5/1973 | Shimizu | 285/114 X |

FOREIGN PATENTS OR APPLICATIONS

| | | | |
|---|---|---|---|
| 1,499,461 | 9/1967 | France | 285/114 |
| 1,450,409 | 5/1969 | Germany | 285/114 |

*Primary Examiner*—Thomas F. Callaghan
*Attorney, Agent, or Firm*—Brisebois & Kruger

[57] ABSTRACT

Joint to be used between culvert sections and the like comprising short tubular flexible members made of elastic material to be attached to the ends of adjoining culvert sections and a plurality of strengthening members extending between the ends of these sections. The strengthening members are provided inside and outside of said flexible members and are adjustable to accommodate variations in the gap between the adjoining sections.

8 Claims, 8 Drawing Figures

F I G. 3
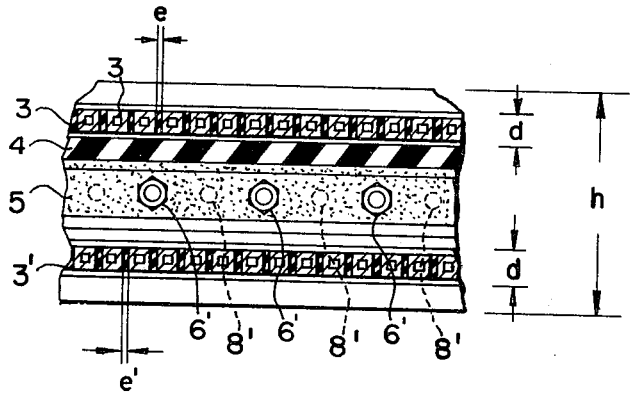
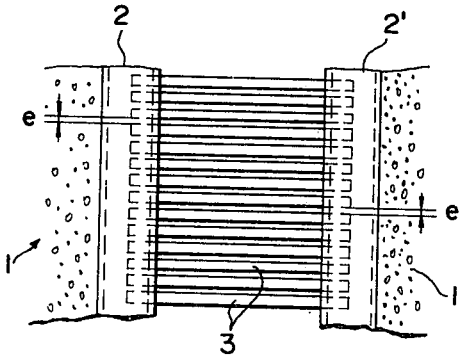
F I G. 4(a)
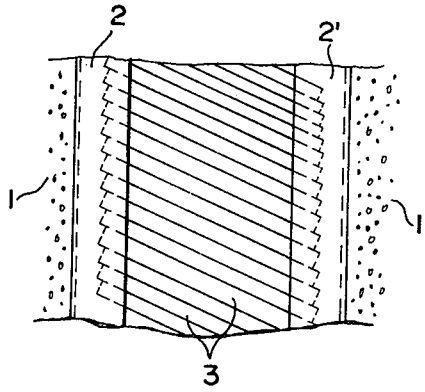
F I G. 4(b)

JOINT FOR CULVERT SECTIONS AND THE LIKE

The present invention relates to a joint that can adapt itself to the uneven subsidence of culvert sections and the like.

In the conventional method of coping with the uneven subsidence of a culvert, the joint between concrete culvert sections is made of elastic material such as rubber or synthetic resin and both ends of a short tubular flexible member constituting this joint are anchored around the opposed internal surfaces of the culverts. Alternatively, a bolt is attached to the back of the flexible member and part of said flexible member is suspended from said bolt, thereby minimizing the strain in said flexible member due to the difference between internal and external water pressures in the culvert. In both cases the earth pressure acting at the joint between the culvert sections is borne by a concrete mass poured behind the whole flexible member so that the flexible member bears only the internal water pressure and the ground water pressure. Thus in the event of a heavy uneven subsidence of the ground or displacement of the culvert sections in a longitudinal direction or in a direction perpendicular to the longitudinal direction during an earthquake, with the result that the gap at the junction remarkably widens, the mud and sand located around the culverts come into direct contact with the flexible member, causing a heavy earth pressure to act directly on the flexible member, whereupon a harmful strain develops in the flexible member and not only is the water flow impeded, but the durability of the flexible member is often decreased.

Thus in the conventional method, when the gap at the junction of culverts widens as the result of a heavy uneven subsidence, the mud and sand located around the culverts come into direct contact with the flexible member and the crushed stones contained therein or the rolling stones, wood or iron pieces carried by the water flowing in the culvert damage the flexible member, often leading to breakage of said flexible member.

Further when, as the result of an uneven subsidence of the ground the adjoining culvert sections are substantially displaced at the joint therebetween in a direction perpendicular to the longitudinal direction of the culvert and in consequence the gap at the joint substantially widens, the surface of the flexible member located inside of the joint between the culvert sections develops a large number of folds which tend to greatly increase the resistance to water flow. To minimize the development of such a harmful strain in the flexible member due to the water pressure difference between the inside and outside of the culvert, bolts are provided at specific intervals on the back side of the flexible member, thereby suspending one end of said flexible member. In that case, however, the culverts cannot smoothly follow the uneven subsidence of the ground on account of the resistance of the bolts to the deformation which develops when the adjoining culvert sections are displaced to different extents at the joint, in a direction perpendicular to the longitudinal direction, and this leads to many other inconveniences.

According to the present invention which aims at elimination of these inconveniences, a short tubular flexible member is provided extending over the anchor members at the opposed ends of the culvert sections to be joined so as to maintain the watertightness of the whole joint, while a strengthening member is loosely attached to the inside and outside of said flexible member to bear and transmit the internal and external water pressures and the earth pressure to said anchor members, thereby perfectly protecting said flexible member against damage from inside and outside of the joint. Moreover, the interchangeability and repairability are good, because the strengthening member and the flexible member can be easily taken into and out of the culvert. It goes without saying that the flexible member is not broken in the event of an earthquake. Moreover, the displacement of the strengthening member is completely free within the allowable limits and accordingly the strengthening member can very smoothly follow a heavy uneven subsidence while maintaining excellent water tightness. Since the inside surface of the joint can always be kept flat and smooth even under uneven subsidence, there is practically no loss in water head when the joint is used in culverts in which water flows. Thus this joint can be effectively applied not only in culverts for water supply and sewerage but also in underpass and community ducts where only the underwater pressure and the earth pressure are at work.

A preferred embodiment of my invention will now be described with reference to the accompanying drawings, in which:

FIG. 3 is a sectional view taken along the line III—III of FIG. 2.

Figure 1:
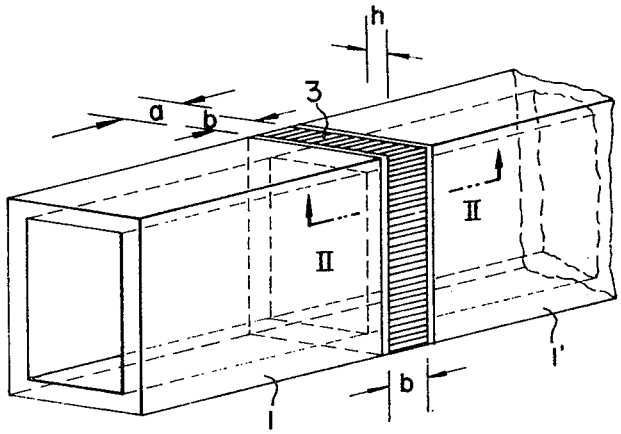
FIG. 1 is an oblique view of a joint in a culvert having a square section utilizing the present invention.

FIGS. 4*a* and 4*b* are side views of the joint in FIG. 1, FIG. 4*a* showing the initial installed state of the joint connecting two culvert sections and FIG. 4*b* showing the joint after the allowable limit of displacement has been reached under uneven subsidence.

Figure 5:
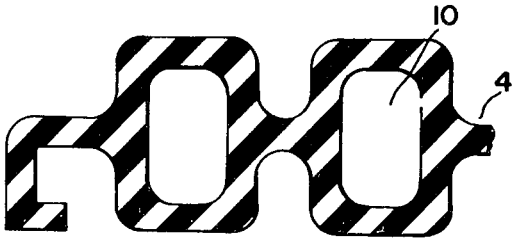

FIG. 5 is a partial sectional view of the flexible member in another embodiment of the present invention.

Figure 6:
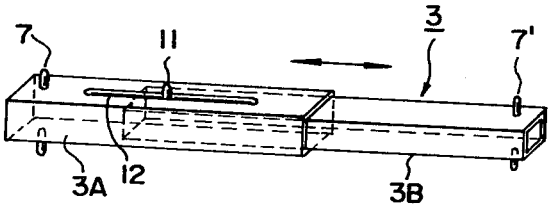

FIG. 6 is an oblique view of the strengthening member in another embodiment of the present invention.

Figure 7:
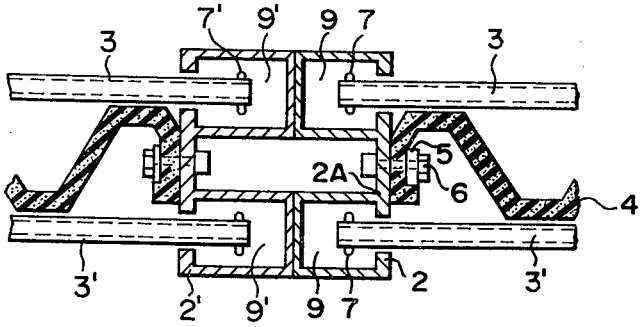

FIG. 7 shows a section of the joints where the joints of this invention are connected in the longitudinal direction of a culvert.

Figure 2:
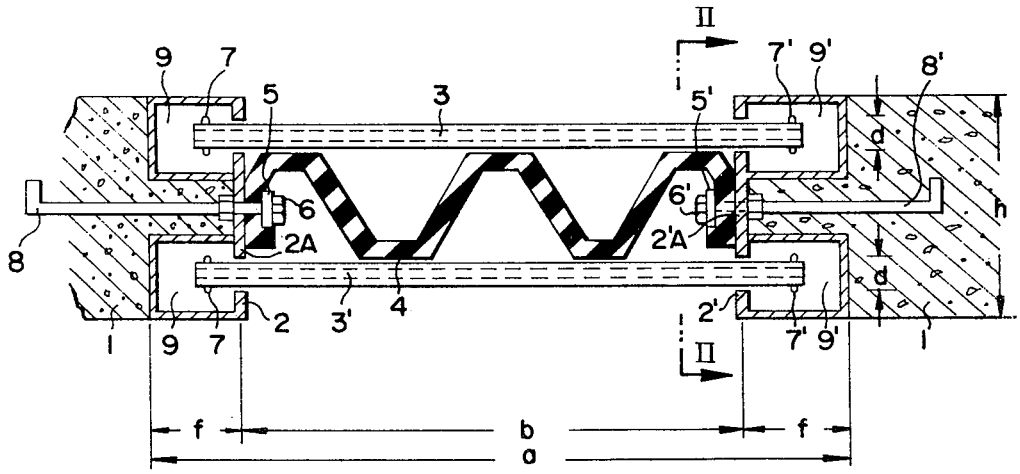
FIG. 2 is an enlarged sectional view taken along the line II—II of FIG. 1.

In FIGS. 1 to 3, reference numerals 1 and 1′ indicate the culvert sections to be joined, which are square or circular concrete tubes. Generally rectangular or circular anchor members 2, 2′ are attached to the opposed ends of the culvert sections 1, 1′. The anchor member 2 consists of the seat 2A to which the end of the short tubular flexible member 4 fabricated of rubber or synthetic resin is fastened and the cavities 9, 9′ provided inside and outside thereof straddling the seat 2A. The anchor member 2 is firmly attached to the culvert 1 by means of the anchor bolt 8.

These anchor members 2, 2′ are fastened to the opposed ends of the culvert sections with a space *b* between them. The two ends of the short tubular flexible member 4 made of rubber or synthetic resin and having a corrugated section are anchored between the seats 2A, 2A′ of said anchor members 2, 2′. The ends of the strengthening members 3, 3′ are inserted into the cavities 9, 9′ provided inside and outside the seats 2A, 2A′, so that the projections 7, 7′ at the ends of the strengthening members 3, 3′ prevent the strengthening members from pulling out of the cavities 9, 9′. The cavities 9, 9′ are continuous recesses following the sectional profile of the culvert sections 1, 1′ with the width *d* of their open edges slightly larger than the diameter of the strengthening members 3, 3′ so that said members 3, 3′ can freely follow the uneven subsidence of the culvert sections 1, 1′. The strengthening members 3, 3′ are square or circular in section and a large number of them are inserted parallel to each other into the cavities 9, 9′ provided at the ends of the culvert sections 1, 1′, in a generally tubular arrangement. The gap *e* between the adjacent strengthening members is needed for the purpose of permitting smooth displacement of the adjoining culvert sections 1, 1′ in a direction perpendicular to the longitudinal direction of the culverts during uneven subsidence of the ground. The gap *e* is filled with a soft elastic material such as sponge rubber or with a plastic asphalt or putty to prevent the mud and sand around the joint from getting into the gap *e* or into the cavity in which the flexible member 4 surrounded by the strengthening members 3, 3′ is located as well as to secure a space required for installation of strengthening members. The flexible member 4 is a short tube, the edges of which are held by means of washers 5, 5′ and nuts 6, 6′ carried by suitable bolts against the central seats 2A, 2A′ of the anchor members 2, 2′. These bolts and nuts can be introduced or removed from within the culvert by removing the strengthening members 3′ inside of the joint, which is dismountable from within the culverts 1, 1′. The flexible member 4 illustrated in FIG. 2 is made corrugated in section so that it can elastically deform and the one illustrated in FIG. 5 has many annular cavities 10 in its section. A flexible member with such cavities can deform to accommodate substantial displacement of adjoining culvert sections.

If the culvert sections 1, 1′ are displaced in the longitudinal direction so that the gap between the culverts 1, 1′ widens, then the displacement will be allowed only until the projections 7, 7′ at the ends of the strengthening members 3, 3′ strike the open edges of the cavities 9, 9′, so that a forced deformation of the flexible member 4 due to excessive displacement as well as a cut off of the adjoining culverts at the joint can be avoided. If there is progressive uneven subsidence of the culverts 1, 1′, the gap *e* between the strengthening members 3 linking the anchor members 2, 2′ will gradually decrease; and when the allowable subsidence is reached, the gap will virtually vanish with the strengthening members at the side wall of the joint being forced closely against each other. FIGS. 4*a* and 4*b* illustrate the position of the strengthening members at the sides of the joint before and after their displacement when the adjoining culvert sections 1, 1′ are displaced in a transverse direction. FIG. 4*a* illustrates their position before uneven subsidence and FIG. 4*b* illustrates their position after the allowable displacement of the adjoining culvert sections has been reached.

In the illustrated example the strengthening member 3 is a bar but, as shown in FIG. 6, it is possible to combine large and small square telescopic pipes 3A, 3B or circular telescopic pipes, so that an increase in the distance between supports caused by uneven subsidence can be accommodated by mutual sliding of these pipes. According to this arrangement, the expansion and contraction of the strengthening member can be further increased and the insertion and removal of the strengthening members 3, 3′ into and out of the culvert sections 1, 1′ can be rendered very easy. Moreover, a projection 11 may be provided on one part of a small-diameter pipe 3B and a slot 12 may be formed in the longitudinal direction of a large-diameter pipe 3A so that said projection 11 can slide in said slot 12. Thus a disconnection as the result of the slidable limit being exceeded due to advanced uneven subsidence can be prevented and a failure of the flexible member 4 due to stretching beyond the allowable limit can be avoided.

Under such an arrangement according to the present invention the earth pressure acting from around the joint can be fully borne by the outside strengthening members 3, while the harmful deformation due to the external pressure which naturally affects the flexible member 4 surrounded by the strengthening members 3, 3′ can be perfectly prevented by the inside strengthening member 3′, while at the same time the development of a harmful internal stress which is a major cause of impaired durability in the flexible member 4 can be avoided.

The load acting on the inside and outside strengthening members 3, 3′ is transmitted to the anchor members 2, 2′ with high rigidity and strength attached to the culvert sections 1, 1′ and one part of the transmitted load can be absorbed by the concrete mass of the culvert sections through the anchor bolts 8, 8′.

The internal water pressure acts on the flexible member 4 just like the external water pressure, but the outside strengthening member 3 covering the entire outside of the flexible member prevents a harmful deformation of said flexible member due to the internal water pressure, and also prevents a harmful internal stress from developing in said flexible member and causing a decline in its durability. The inside and outside strengthening members 3, 3′, which completely enclose the flexible member 4, assure perfect protection of the flexible member from damage or failure due to mud and sand collecting or falling during backfilling around the joint, or due to angular stones contained in the mud and sand or due to the gravel, wood and iron pieces contained in the water flowing through the culverts.

Furthermore, according to the present invention, when the uneven subsidence of adjoining culvert sections is large, on account of the inside strengthening members 3′ continuously arrenged in parallel within the joint, the inside surface of the joint can generally remain as a wall with a flat, smooth surface. There is therefore a very small loss of head in the fluid and good hydraulic conditions can be maintained. Since the flexible member is protected within the enclosure of strengthening members, there is no likelihood, as observed with the conventional practice, of the flexible member being injured by the concrete edge and suffering a loss in durability under uneven subsidence of the culvert.

FIG. 7 illustrates another embodiment of the present invention in an arrangement that one set of the joint, shown in FIG. 2, comprising the anchor members 2, 2′, the strengthening members 3, 3′ and the tubular flexible member 4 is secured to the other set of the joint so as to oppositely face the anchor member 2 of the one joint with the anchor member 2′ of the other joint in a longitudinal direction of the culvert. Especially, it shows a sectional view of the secured portion of the one joint and the other joint. The other portions of the culvert are the same as the ones shown in FIG. 2 and those portions are omitted from FIG. 7. In this arrangement, the hydraulic conditions and function of the culvert are not disturbed by any heavy uneven subsidence and the displacement of the culvert can be easily absorbed.

What is claimed is:

1. Joint for connecting culvert sections and the like comprising a. a short tubular flexible member of elastic material each end of which is adapted to be attached to one of the adjacent ends of two aligned culvert sections;

b. a plurality of rigid, substantially parallel, closely spaced strengthening members extending between the adjacent ends of said culvert sections both inside and outside of said flexible member to form protective cages around and within said tubular member which substantially inhibit the application of transverse pressure to said tubular member; and c. means for loosely connecting the ends of said strengthening members to the adjacent ends of said culverts so that said strengthening members can swing to permit relative lateral displacement of said culvert sections.

2. Joint as claimed in claim 1, in which said connecting means comprises a pair of anchor members having seats for said tubular flexible members and annular cavities inside and outside of said seats which receive said strengthening members.

3. Joint as claimed in claim 1, in which said tubular flexible member has a corrugated side wall.

4. Joint as claimed in claim 1, in which the wall of said tubular flexible member has a large number of annular cavities.

5. Joint as claimed in claim 2 in which each said strengthening member has a projection at each end thereof which fits loosely into a cavity in an anchor member.

6. Joint as claimed in claim 1, in which the space between adjacent strengthening members is filled with an elastic material.

7. Joint as claimed in claim 1, in which said strengthening members consist of pipes and bars slidably inserted in said pipes.

8. Joint for connecting culvert sections and the like comprising.

a. a plurality of anchor members adapted to be fitted between aligned culvert sections;

b. a plurality of short tubular flexible members fitted between said plurality of anchor members; and c. a plurality of rigid, substantially parallel, closely spaced strengthening members loosely connected inside and outside of said flexible members between said anchor members such that they can follow lateral displacement of said culvert sections, and form protective cages around and within said tubular members which substantially inhibit the application of transverse pressure to said tubular member.

* * * * *